United States Patent [19]

Cramer et al.

[11] 4,431,597

[45] Feb. 14, 1984

[54] HORIZONTAL MIXING AERATOR

[75] Inventors: Barry G. Cramer; Roy A. Cramer, both of Kansas City, Mo.

[73] Assignee: Air-O-Lator Corporation, Kansas City, Mo.

[21] Appl. No.: 427,144

[22] Filed: Sep. 29, 1982

[51] Int. Cl.[3] ..... B01F 13/02

[52] U.S. Cl. ..... 261/93; 261/DIG. 47; 261/DIG. 75; 366/261; 366/102; 366/285

[58] Field of Search ..... 366/102, 168, 261, 241, 366/279, 285, 286; 248/241, 652, 669; 415/209, 61; 417/423; 261/87, 93, DIG. 47, DIG. 75

[56] References Cited

U.S. PATENT DOCUMENTS

| | | | |
|---|---|---|---|
| 1,583,141 | 5/1926 | Greenawalt | 261/93 |
| 3,123,652 | 3/1964 | Gross | 261/93 |
| 3,202,281 | 8/1965 | Weston | 366/279 |
| 3,341,450 | 9/1967 | Ciabattari et al. | 366/326 |
| 3,365,178 | 1/1968 | Bood | 261/DIG. 75 |
| 3,488,038 | 1/1970 | Staaf | 366/330 |
| 3,635,448 | 1/1972 | Okada | 366/314 |
| 3,778,233 | 12/1973 | Blough et al. | 261/93 |
| 4,014,526 | 3/1977 | Cramer, Jr. | 366/343 |
| 4,133,850 | 1/1979 | Hauser | 261/93 |
| 4,290,885 | 9/1981 | Kwak | 261/93 |

*Primary Examiner*—Harvey C. Hornsby
*Assistant Examiner*—Michael Knick
*Attorney, Agent, or Firm*—Litman, Day & McMahon

[57] ABSTRACT

A horizontal mixing aerator rides on an upright beam member for submersion in a body of water such as an equalization basin, oxidation ditch, or sludge holding tank. The aerator employs a submersible mixer motor driving a propeller which in one embodiment is mounted on the beam member by a slidable bracket for height adjustment. The bracket is also swingably mounted to the beam member for adjustment of the vertical plane angle. Because the beam member is also mounted for rotation, substantially any attitude or position of the mixer can be selected for creating an efficient flow pattern within the body of water. Air or fluid injection can also be provided by the use of alternate embodiments.

9 Claims, 13 Drawing Figures

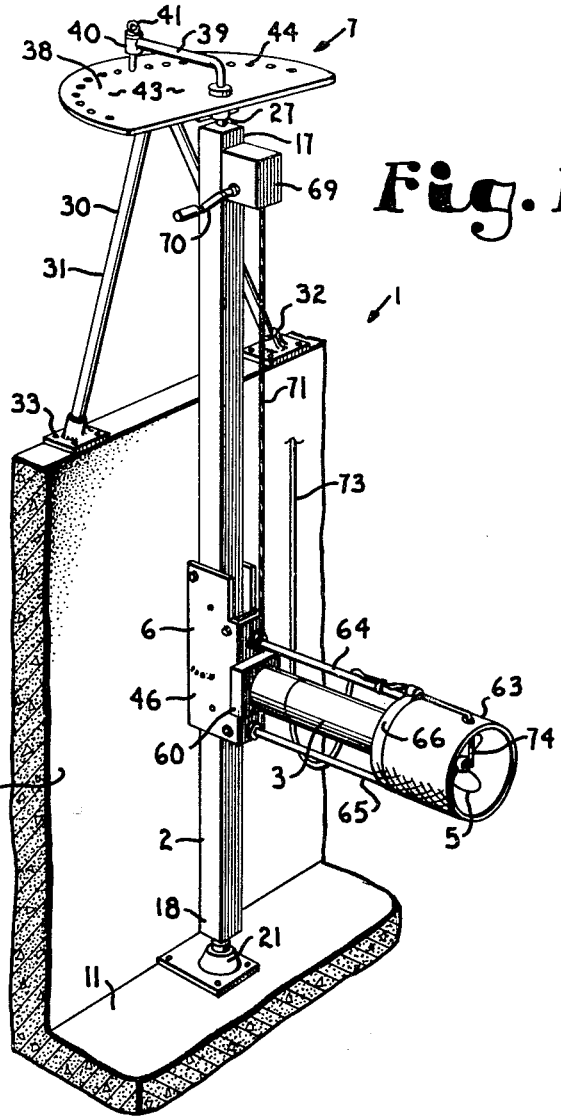
Fig. 1.
Fig. 2.
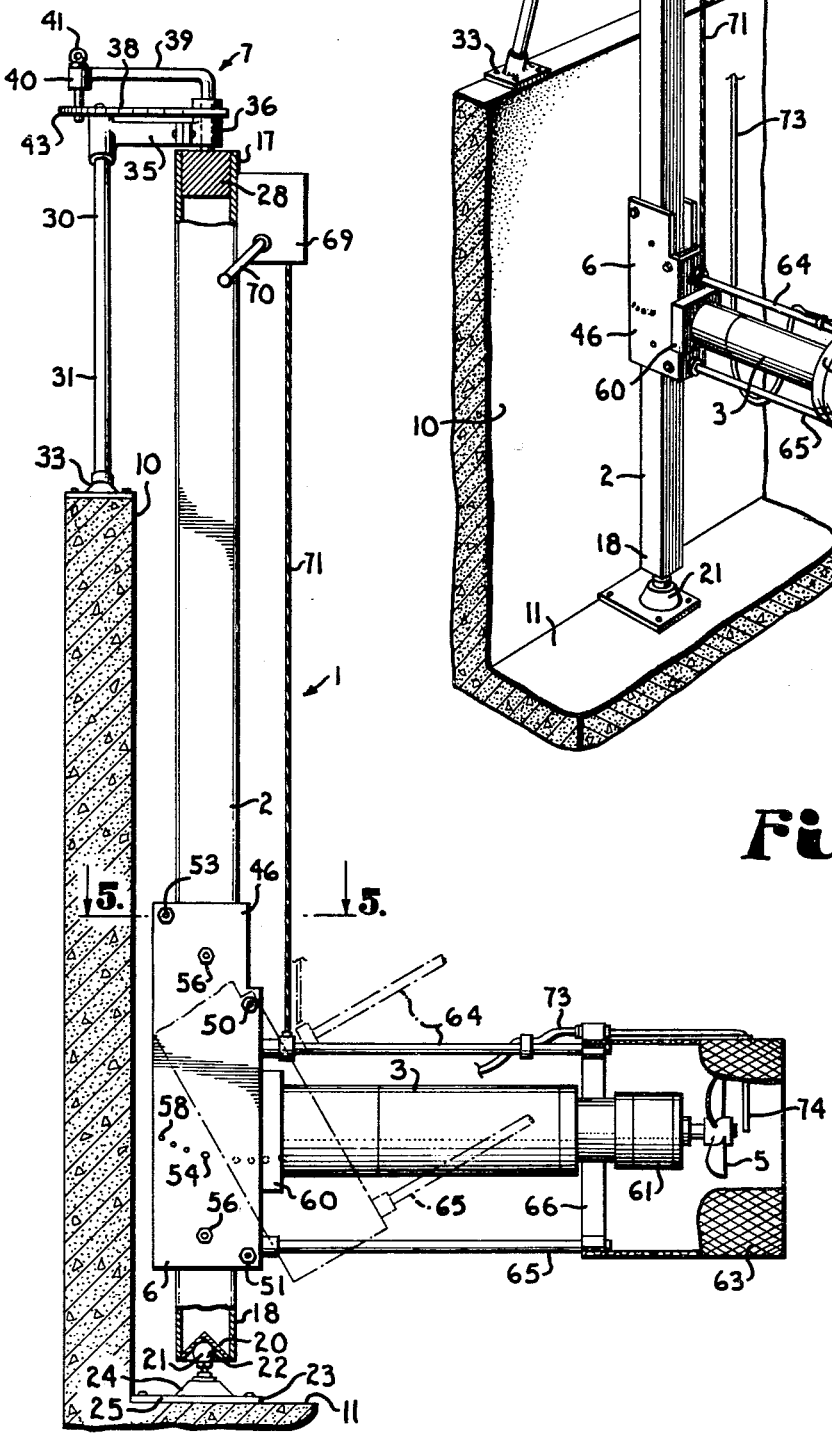
Fig. 6.
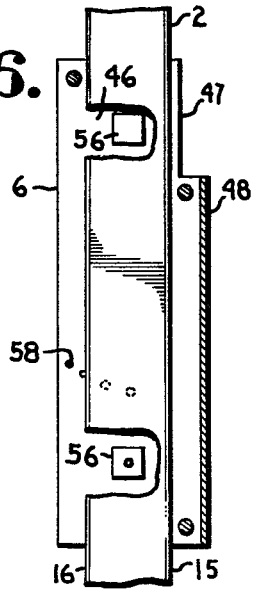

Fig. 3.
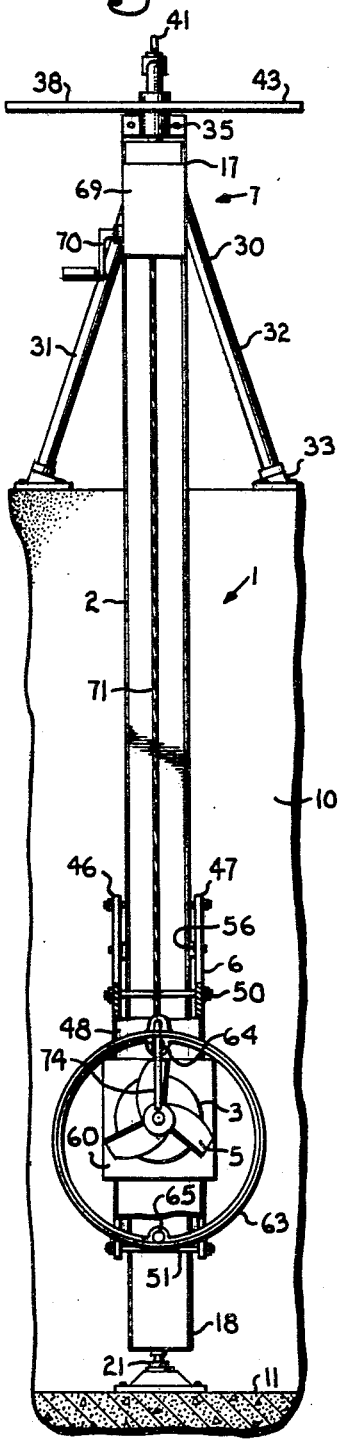
Fig. 4.
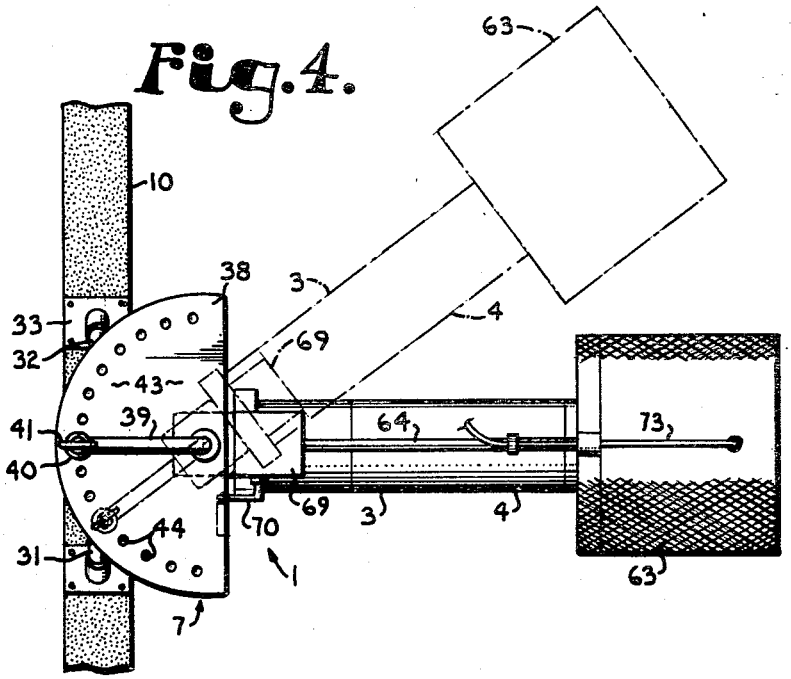
Fig. 5.
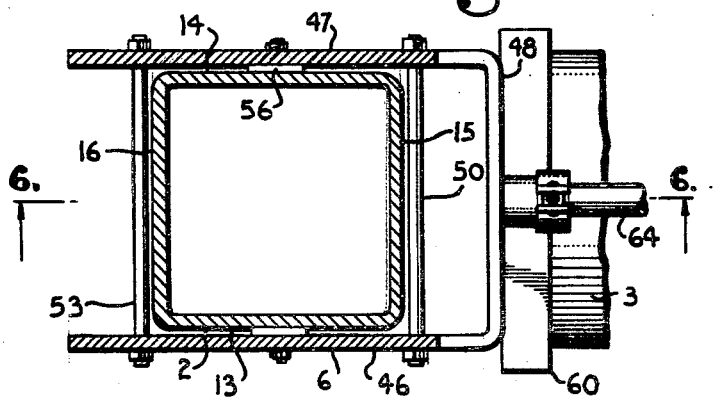
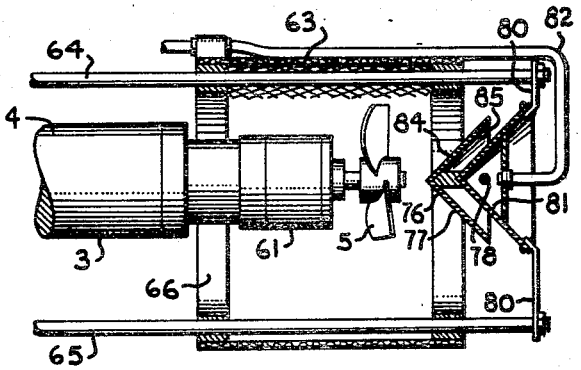
Fig. 7.

Fig. 8.
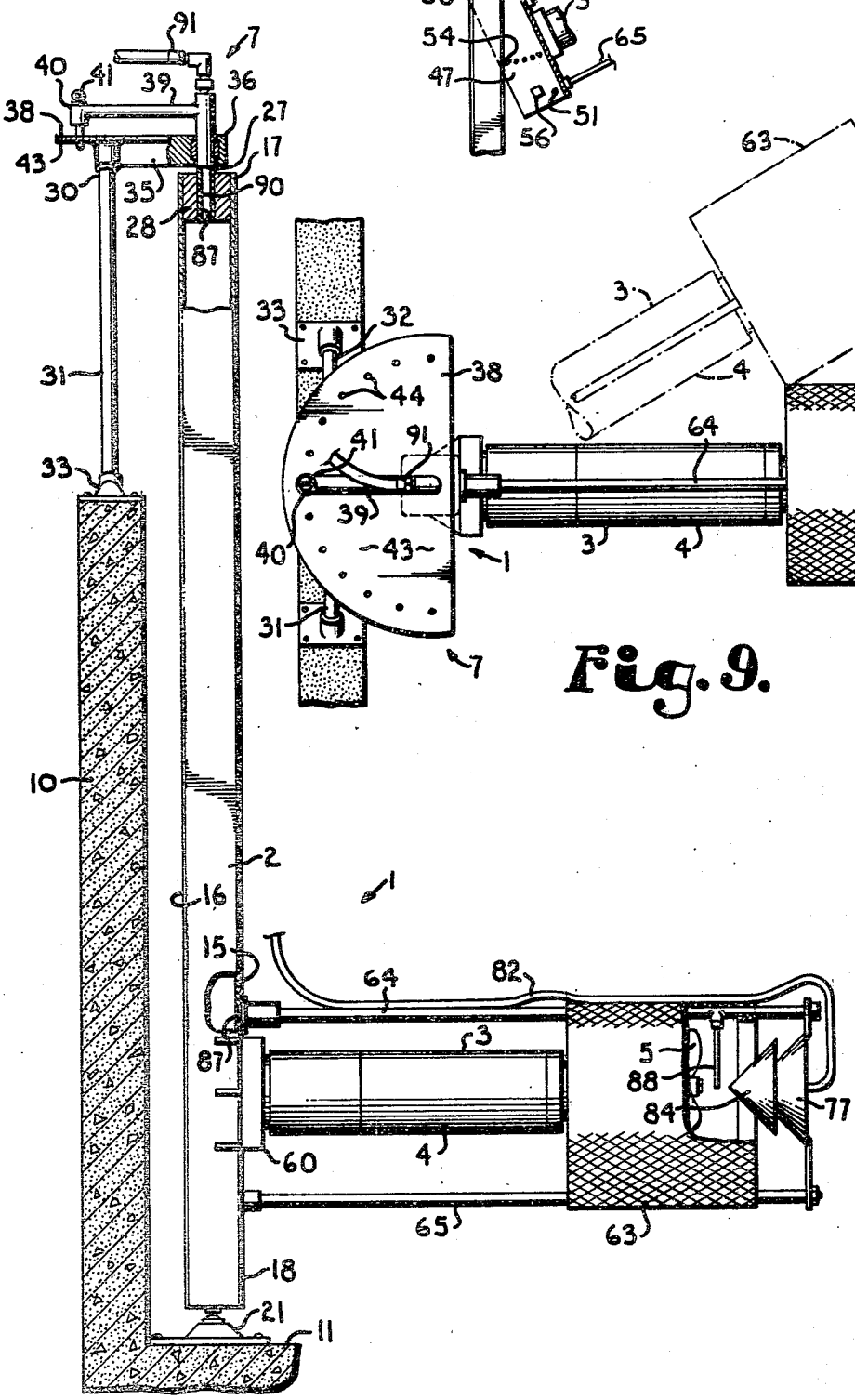
Fig. 10.
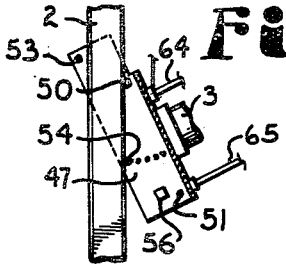
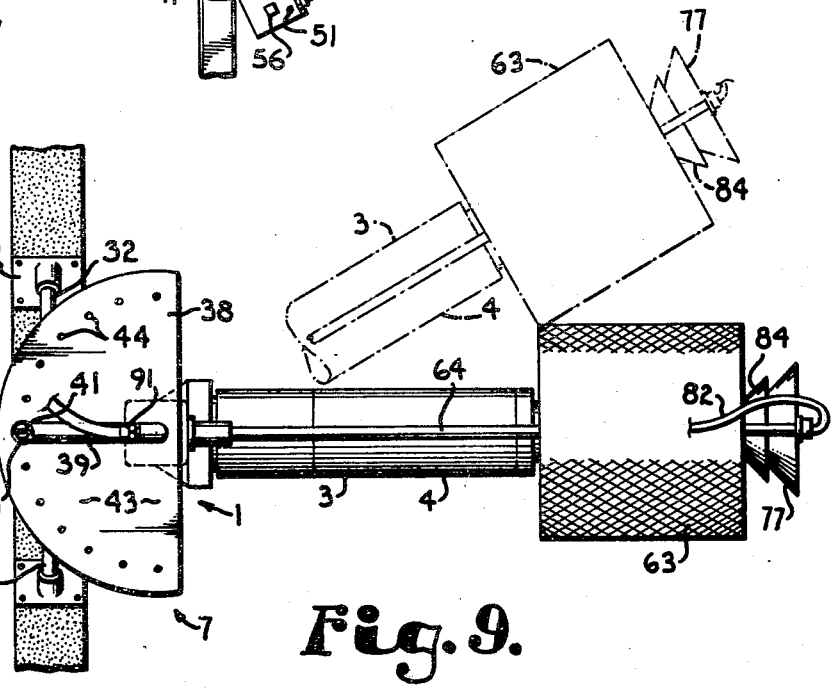
Fig. 9.

Fig. 11.
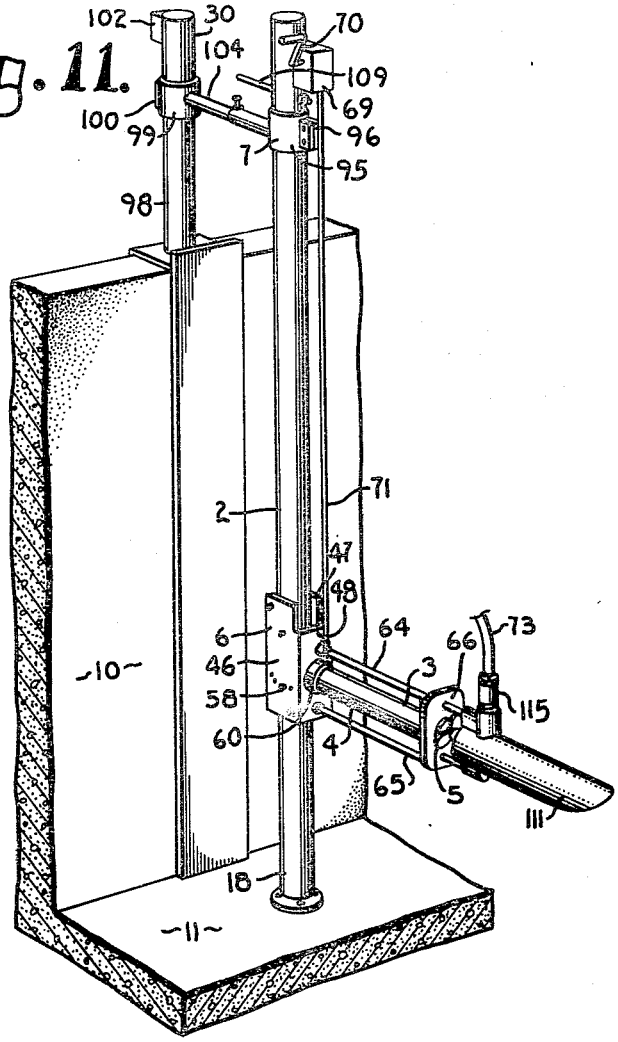
Fig. 12.
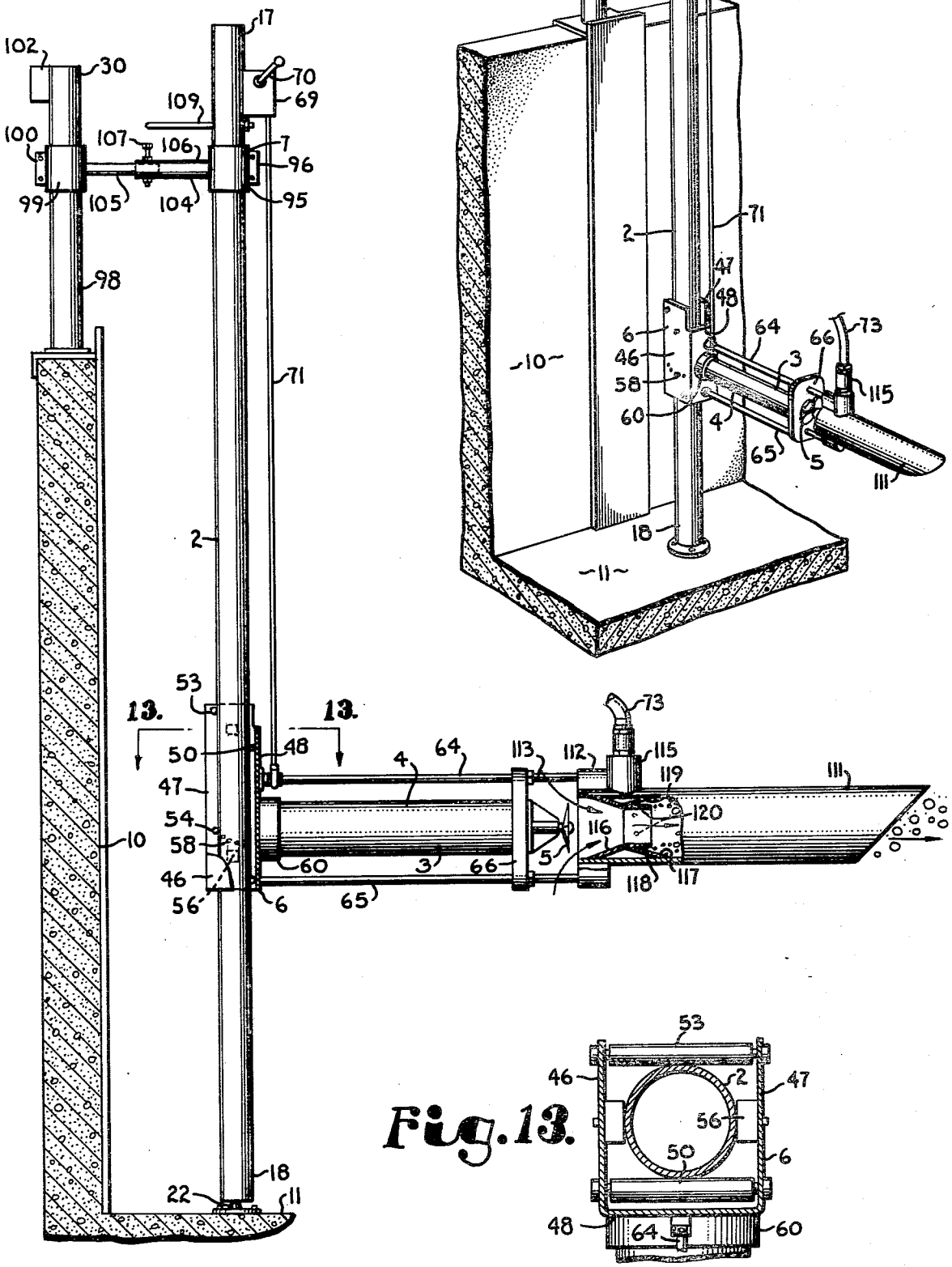
Fig. 13.

HORIZONTAL MIXING AERATOR

This invention relates to mixing devices in general and in particular to a mixing aerator which can be positioned within a body of a liquid to direct a mixing flow as desired.

BACKGROUND OF THE INVENTION

In the mixing of large bodies of liquid, several different types of mixers have been used, such as water floats and pumps. Generally, the floatation type is not sufficiently controllable in all directions of flow for efficient mixing. Further, pumps and the like are susceptible to clogging and often do not provide sufficient rate of flow for the efficient mixing required in equalization basins, as well as oxidation ditches, sludge holding tanks and other special applications. Mixers are also used in aerated lagoons in which active biological solids are in equilibrium with an applied waste. The basin is of sufficient depth, normally six to twelve feet and oxygen is furnished by mechanical aeration to create a turbulence level sufficient to provide adequate liquid mixing. As a result of the mixing, uniform distribution of the waste and dispersion of the oxygen is achieved and rapid and efficient waste biodegration occurs.

Mixers such as the Flygt 4500 Submersible Mixer have been employed with generally acceptable results for mixing in tanks, ponds and lagoons. However, such mixers are often not sufficiently controllable in direction of flow for maximum efficiency. For example, the Flygt mixer does not have tilt capability wherein the motor and propeller can be positioned above the high concentration of bottom settled solids in a tank and flow thereof created from the bottom of the tank to loosen packed solids settled out along the tank bottom. Rather, the mixer must be positioned horizontally as close to the bottom of the tank as possible wherein level mixing occurs which indirectly tends to stir the tank bottom.

OBJECTS OF THE INVENTION

The principal objects of the present invention are: to provide a mixing aerator which can be easily adjusted to any depth within a tank; to provide such a mixing aerator which can be easily adjusted to any horizontal angle or azimuth; to provide such a mixing aerator which can be easily adjusted to any vertical plane or tilt angle; to provide such a mixing aerator which has a submersible motor of stainless steel construction which is liquid cooled and liquid lubricated; to provide such a mixing aerator which increases the degree and uniformity of mixture in a tank, basin, ditch and the like; to provide such a mixing aerator which includes air injection for increased mixing of oxygen within a body of liquid; to provide such a mixing aerator which injects fluids such as chlorine, alum or polymers which can be flash mixed with great efficiency; and to provide such a mixing aerator which is sturdy and efficient in use and particularly well adapted for its intended purpose.

Other objects and advantages of this apparatus will become apparent from the following description taken in conjunction with the accompanying drawings wherein are set forth, by way of illustration and example, certain embodiments of this invention.

DESCRIPTION OF THE DRAWINGS

FIG. 1 is a perspective view of a mixing aerator embodying the present invention and is shown in connection with a portion of a tank wall.

FIG. 2 is a side elevational view of the mixing aerator and showing upward tilting of a motor and propeller power unit.

FIG. 3 is a front elevational view of the mixing aerator.

FIG. 4 is a plan view of the mixing aerator showing variations of the azimuth or horizontal direction of the power unit.

FIG. 5 is an enlarged sectional view taken along lines 5—5, FIG. 2.

FIG. 6. is an enlarged longitudinal sectional view of a mounting bracket taken along lines 6—6, FIG. 5.

FIG. 7 is an enlarged fragmentary view of a portion of the power section and showing an alternate embodiment thereof including a means for injection of fluids into the liquid flow path.

FIG. 8 is a side elevational view of the mixing aerator showing a second alternate embodiment thereof.

FIG. 9 is a plan view of the mixing aerator shown in FIG. 8 and depicting azimuth variation thereof.

FIG. 10 is a fragmentary view of the mixing aerator showing adjustment of vertical plane angle or tilt.

DESCRIPTION OF THE PREFERRED AND ALTERNATE EMBODIMENTS

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to the drawings in more detail:

The reference numeral 1 generally indicates a mixing aerator embodying the present invention. In overview, the aerator 1 includes an upright beam member or post 2 supported at top and bottom ends and which extends into a body of liquid such as an equalization basin, oxidation ditch or sludge holding tank. A power unit 3 includes a submersible motor 4 driving a propulsion means such as a propeller 5 to create a mixing flow or current within a body of liquid. The power unit 3 is connected to the upright beam member or post 2 by a bracket 6 which is vertically movable on the upright beam member or post 2 in order to adjust to a selected height.

Further, the upright beam member or post 2 is rotatable through a rotary support means 7 for controlling azimuth of the path of fluid flow from the power unit 3. Preferably, the bracket 6 is tiltable on the upright beam member or post 2, FIGS. 2 and 10, for imparting a vertically angled direction of current or flow to the body of liquid.

In the illustrated example, FIGS. 1, 2 and 3 the upright beam member or post 2 is mounted adjacent a side wall 10 of a suitable basin, pond, ditch or the like and rests upon the basin bottom 11.

The exemplary upright beam member or post 2 is of square tubing structural steel having opposite side surfaces 13 and 14 and front and rear surfaces 15 and 16, FIG. 5. The beam member post 2 has opposite upper end and bottom end portions 17 and 18 with the upper end portion 17 extending above the surface of a body of liquid retained by the basin side walls 10 and bottom 11 and the bottom end portion 18 supported upon the basin bottom 11. Upper and lower pivot means are mounted at the upper and bottom end portions 17 and 18 and enable rotation about the longitudinal axis of the upright beam member or post 2 for adjusting the azimuth or direction of thrust of the power unit 3.

For the lower pivot means, a ball pivot is preferably employed, FIG. 2, which configuration includes a concave wall within the bottom end portion 18, such as of converging pyrimidal shape 20 into which is received an upstanding ball pivot 21. The ball pivot 21 includes a circular ball head 22 supported upon a base member 23 including an upwardly extending truncated cone portion 24 and a surrounding flange 25.

The upper pivot means, FIG. 2, includes a cylindrical shaft 27 suitably supported in an upright relationship by structures set forth below and secured to a plug or block 28 within the upper end portion 17.

A support structure 30 holds the beam member or post 2 in an upright relationship and, in the illustrated example, includes converging legs 31 and 32 which have respective foot pads 33 attached to upper edges of the basin side wall 10.

Upper ends of the legs 31 and 32 join at a pivot support arm 35 which includes an end journal 36 which rotatably receives the pivot shaft 27. A rotation limiting means 38 extends between the support legs 31 and 32 and the beam member or post 2 for setting the amount of azimuth rotation. In the illustrated example, the rotation limiting means 38 includes an arm 39 extending at a right angle from the shaft 27 and rotatable therewith as the beam member or post 2 turns. An end portion 40 has a bore therethrough which receives a removable lock pin 41.

Further comprising the rotation limiting means 38 is a plate 43 secured as by welding to the pivot support arm 35. The exemplary plate 43 is semi-circular in configuration and has an arcuate series of bores 44 positioned in arcuate alignment with the sweep of the arm 39 whereby the lock pin 41 can be engaged in a selected bore 45 to control the azimuth of the power unit 3, FIG. 4.

The power unit 3 is mounted to the upright beam member or post 2 and in the embodiments of FIGS. 1–7, the bracket 6 provides a mounting connection between the power unit and the beam member. The exemplary bracket 6 is U-shaped and has opposite side walls 46 and 47 and a front end wall 48, FIG. 5. The bracket 6 is preferably movably engaged with the beam member or post 2 and, referring to FIGS. 3 and 5, is of a transverse dimension greater than the beam member 2 and includes a plurality of means facilitating sliding action, such as guide pins. In the illustrated example, the bracket 6 is fitted with front upper and lower guide pins 50 and 51 and rear upper and lower guide sets or pins 53 and 54. Each of the guide pins 50, 51, 53 and 54 is an elongate bolt of suitable diameter to provide relatively smooth, catch-free sliding upon the front and rear surfaces 15 and 16 of the beam member or post 2. Additionally, slides or bumpers 56, such as of nylon, are interposed between the bracket side walls 46 and 47 and the beam member side surfaces 13 and 14.

Means facilating tilting extend between the bracket 6 and the beam member or post 2 and in the illustrated example, include an arcuate series of pairs of bores 58 which extend through the opposed bracket side walls 46 and 47. The rear lower guide pin 54 is selectively removable and engageable through opposite pairs of the series of bores 58 to set the tilt of the bracket 6, FIG. 2. In all positions of upward tilt, the lower rear guide pin 54 engages the front surface 15 of the beam member 2 and serves as a block to prevent further rearward movement, or return to horizontal orientation, as caused by the weight of the power unit 3.

The power unit 3 with its motor 4 and propeller 5 is mounted to the bracket 6 and extend outwardly thereof, and in the illustrated example, the motor 4 is connected to a mounting block 60 secured as by welding to the front end wall 48 of the bracket 6. The motor 4 is mounted upon the block 60 as by bolts or the like and extends outwardly thereof at a right angle to the bracket 6. A gear reduction unit 61 is axially aligned with the motor 4 and reduces motor speed to the propeller 5.

A shroud 63 in the form of a cylindrical wire cage extends over the area of the propeller 5. The shroud 63 is supported by upper and lower mounting rods 64 and 65 threadably mounted to the bracket end wall 48 and extending outwardly at a right angle. Rods 64 and 65 connect at an outward end to a ring 66, FIG. 2 to which the shroud 63 is attached.

Means for controlling the depth or height of the power unit 3 are provided and in the illustrated example include a winch arrangement attached to the bracket 6. A hand winch 69 with a crank handle 70 is operably connected to a cable 71 which is connected at its remote end to the upper mounting rod 64. The winch 69 is equipped with locking means such as a clutch or ratchet whereby the bracket 6 can be raised or lowered to a selected depth position and retained in that position.

In the example of the aerator shown in FIGS. 1 and 2, a gas injection means is provided and includes a flexible line or hose 73 leading from a source of compressed gas (not shown). The line or hose 73 extends along the upper mounting rod 64 of the bracket 6 and terminates at a nozzle 74 positioned immediately adjacent the propeller 5 and in the liquid flow path. Various gases such as oxygen, carbon dioxide and the like are injected into the liquid body through the nozzle 74.

In the alternate embodiments shown in FIGS. 7, 8 and 9, the propeller 5 directs a flow of liquid toward an apex 76 of a diffusing member 77 which directs the flow outwardly. Liquid flow around the diffusing member 77 cooperates with a flow of a selected material outwardly through a suitable orifice or orifices 78 and into the body of liquid so that the liquid and material mix together during turbulent flow created by the propeller 5.

The diffusing member 77 is mounted on arms 80, FIG. 7, projecting from extended ends of the upper and lower mounting rods 64 and 65 and is positioned in axial alignment with a propeller 5. The diffusing member 77 is cone-shaped to provide resistance while diffusing or diverting the liquid flow outwardly, thereby facilitating dispersal of mixed material, such as solids, liquids or gas. The diffusing member 77 has an included angle in the range of between 60 and 90 degrees.

A selected material to be mixed with the body of liquid is communicated to a fluid or material receiving chamber 81 within the diffusing member 77. A tube or hose 82 is suitably connected to the fluid receiving chamber 81 for flow of a selected material from a source of supply to the fluid receiving chamber 81 in the diffusing member 77. The portion of the conical diffusing member 77 between the apex and within the fluid receiving chamber 81 has a plurality of circumferentially spaced ports or orifices 78 for flow of the treating material from the fluid receiving chamber 81.

A venture eductor forming member in the form of a cone-shaped cap or second diffusing member 84 is mounted on the previously described diffusing member 77 and defines an annular orifice surrounding the first described diffusing member 77. The second diffusing or cap member 84 is spaced from the diffusing member 77 thereby defining a space or means communicating the orifices 78 with the flow of selected material between the material receiving chamber 81 and the annular orifice 85 in response to outwardly directed flow effected by the propeller 5 whereby the selected material is mixed with the body of liquid.

The illustrated cap member 84 has a wall that has an angular relation or included angle corresponding to that of the diffusing member 77 and is preferably spaced from and parallel therewith. The wall of the diffusing member 77 and wall of the second diffusing member 84 cooperate to define an annular venture passage arranged so that flow of liquid passing the annular orifice 85 will draw the treating material from the chamber 81 and into the turbulent liquid flow.

In the alternate embodiment showing gas injection FIG. 8, the power unit 3 is connected directly to the upright beam member 2. The upper plug or block 28 is tubular or hollow for insertion of a tubular pivot shaft 27 which has an interior passageway 87 communicating with the interior of the beam member 2. The upper mounting rod 64 is also tubular or hollow at 90 and communicates with the interior passageway 87 for flow of gas. The gas injector nozzle 88 is connected to the upper mounting rod 64 and projects into the flow path of the propeller 5 for purposes of gas injection.

At its upper end portion 17, the beam member 2 has a fluid tight fitting to the bearing block 28 and the shaft 27 has the interior passageway 90 extending the length thereof and connected to a hose 91 which is in turn connected to a source of pressurized gas. Thus, the gas is routed through the inside of the beam member 2 and the beam member 2 also acts as a reservoir for the gas.

In this embodiment, the power unit 3 is variable in height and horizontal plane azimuth although the vertical plane or tilt angle is not variable.

Yet another alternate embodiment is depicted in FIGS. 11 through 13 wherein like numerals to the embodiments shown in FIGS. 1–12 indicate like features. In the embodiment shown in FIGS. 11–13, the beam member or post 2 is tubular in shape and has a ball pivot arrangement at the bottom end portion 18, comprising a lower pivot means. The upper pivot means at the upper end portion 17 includes a first clamp 95 having separable halves and confronting flanges 96 pulled together into a gripping relationship by fasteners.

The support structure 30 maintaining the beam member or post 2 in an upright relationship includes a single vertical leg 98 such as formed of pipe material secured at its bottom end to a top surface of the wall 10. A second clamp 99 is fitted onto the leg 98 and similarly includes separable halves and confronting flanges 100 pulled together into a gripping relationship by fasteners. A stop 102 at a top end of the leg 98 limits upward movement of the second clamp 99.

A telescoping arm 104 extends between the leg 98 and the beam member or post 2 and has opposite ends secured to the respective first and second clamps 95 and 99. The telescoping arm 104 includes an extensible member 105 and a sleeve member 106 retained together by a fastener, such as a bolt, 107. The bolt 107 extends through selected aligned pairs of a plurality of bores through the extensible member 105 from bores in the end of the sleeve member 106. By adjusting the length of the telescoping arm 104, the angle of tilt of the beam member or post 2 varies in order to further vary the tilt of the power unit 3 and the direction of liquid flow therefrom.

A tiller 109 projects rearwardly from the beam member or post 2 from a location above the clamp 95 and serves as an aid in rotating the post 2 in order to vary the azimuth of flow.

In the example shown in FIGS. 11 and 12, the power unit 3 includes an elongate nozzle 111 in the form of a tubular member having an end in flow communication with the propeller 5. The nozzle 111 has one end portion 112 forming a flange affixed by bolts 113 to the outer mounting ring 66 and an inlet 115 for the gas line 73. Converging interior walls 116 in the nozzle 111 form a constriction and join with outwardly flaring walls 117 to form a venturi. A tubular member 118 extends downstream a short distance from the constriction and forms an area 119 of reduced pressure immediately following the constriction. Gas inlet ports in the form of bores 120 extend through the walls 117 and into the reduced pressure area 119 whereby the flow of liquid through the venturi tends to pull the gas through the ports 120 for efficient mixing of air or other gas with the liquid.

It is to be understood that while certain forms of the present invention have been illustrated and described herein, it is not to be limited to the specific forms or arrangement of parts described and shown.

What is claimed and desired to secure by Letters Patent is:

1. A liquid circulating apparatus comprising:
(a) an upright beam member for extending into a body of liquid;
(b) upper and lower support means for holding said beam member in said body;
(c) a U-shaped bracket mounted on said beam member and including spaced sidewalls and an endwall;
(d) a submersible motor mounted on said bracket and extending outwardly of said endwall;
(e) a propulsion means operably connected to and rotatably powered by said motor to effect an outwardly directed flow in said body of liquid; and
(f) means selectively swingably mounting said bracket to said beam member including sets of front and rear guides extending between said bracket sidewalls and capturing said beam member therebetween, said sets of front and rear guides each including upper and lower guides with said lower rear guide being selectively removable and replaceable whereby said bracket swings upwardly against said upper front guide and said lower rear guide engages said beam member for controlling upward tilt and direction of flow of said liquid.

2. The apparatus set forth in claim 1 wherein:
(a) said bracket includes an arcuate series of bores extending through said spaced sidewalls; and
(b) said lower rear guide is a pin which is selectively positionable through opposite ones of said bores.

3. The apparatus set forth in claim 2 including:
(a) a conduit for the passage of a pressurized gas extending toward said motor and terminating in a nozzle means supported adjacent said motor and located forwardly and generally axially of said propeller in the flow path thereof for effecting a flow of pressurized gas into said body.

4. The apparatus set forth in claim 2 wheren:

(a) said lower support means includes a ball and socket joint extending between a lower end of said beam member and a bottom surface of said body of liquid.

5. A liquid circulating apparatus comprising:

(a) an upright beam member for extending into a body of liquid;

(b) upper and lower support means for holding said beam member in said body;

(c) a bracket mounted on said beam member;

(d) a submersible motor mounted on said bracket and extending outwardly thereof;

(e) a propeller operably connected to and rotatably powered by said motor to effect an outwardly directed flow in said body of liquid;

(f) arm structure extended outwardly of said motor and said propeller;

(g) a diffusing member mounted on said arm structure and positioned generally axially of said propeller and in the flow path thereof, said diffusing member having a fluid receiving chamber therein, said diffusing member being cone shaped to diffuse the flow radially outward; and (h) means for communicating to the fluid receiving chamber within said diffusing member a supply of fluid to be mixed into the body of liquid; and (i) means on said diffusing member for defining an annular orifice surrounding said diffusing member and means communicating between the fluid receiving chamber of said diffusing member and the annular orifice for flow of fluid therebetween and outwardly through said annular orifice in response to the flow effected by said propeller whereby the fluid is mixed with the liquid in the body of fluid.

6. A liquid circulating apparatus comprising:

(a) an upright beam member for extending into a body of liquid and having upper and lower ends;

(b) support means for said beam member for holding same in an upright attitude including:

(i) a lower ball pivot at said lower end wherein said lower end has a concave wall and rotatably engages a ball pivot extending from a bottom surface of said body of liquid;

(ii) an upper support arm mounted to said upper end and having an upper pivot means for relative rotation of said beam member relative to said support arms; and (iii) rotation limiting means extending between said support arm and said beam member for setting an amount of rotation;

(c) a U-shaped bracket mounted on said beam member and including spaced sidewalls and an end wall;

(d) a submersible motor mounted on said bracket and extending outwardly of said endwall;

(e) a propeller operably connected to and rotatably powered by said motor to effect an outwardly directed flow in said body of liquid;

(f) a winch mounted to said beam member adjacent said upper end and connected to said bracket in order to selectively raise and lower said motor to control depth of placement in said body of liquid;

(g) means selectively swingably mounting said bracket to said beam member including sets of front and rear guides extending between said bracket sidewalls and capturing said beam member therebetween, said sets of front and rear guides respectively including upper and lower guide pins with said lower rear guide pin being selectively replaceable for swinging said bracket upwardly against said upper front guide pin, said bracket including an arcuate arrangement of guide pin holes through which said lower rear guide pin selectively extends to abut said beam member and set a desired upward angle of said bracket, motor and propeller for controlling upward direction of flow of said liquid.

7. The apparatus set forth in claim 6 wherein:

(a) said rotation limiting means includes a second arm secured to said beam member through said upper pivot means and swingable therewith as said beam member revolves;

(b) said second arm having an end portion removably receiving a lock pin;

(c) a plate member positioned upon said support arm and having an arcuate series of bores corresponding to degrees of rotaton of said beam member; and (d) said lock pin being selectively insertable into on of said bores to lock said beam member a selected degree of rotation.

8. The apparatus set forth in claim 6 wherein:

(a) said upper support arm is spaced from said upper end of said beam member; and (b) a telescoping member extends between said upper support arm and said upper end and includes a fastener for fixing said telescoping member at a selected amount of extension and retraction, thereby varying the inclination of said beam member.

9. A liquid circulating apparatus comprising:

(a) a hollow upright beam member for extending into a body of liquid and having closed upper and lower ends;

(b) upper and lower support means for holding said beam member in said body;

(c) a submersible motor with a propulsion means mounted on said beam member at a height for positioning in said body of liquid to effect an outwardly directed flow in said body; and (d) an arm member connected to and extending outwardly of said beam member at a position adjacent said motor and propulsion means, said arm member having a longitudinal passageway therethrough and connected to a nozzle attached to said arm member and terminating in the flow path of said propulsion means;

(e) whereby said beam member comprises a conduit and a reservoir for a source of pressurized gas which is fed through said arm member and to said nozzle for injection into said body of liquid.

* * * * *